United States Patent [19]

Kishikawa et al.

[11] Patent Number: 5,020,690

[45] Date of Patent: Jun. 4, 1991

[54] POURING PLUG FOR LIQUID CONTAINER

[75] Inventors: Kenjiro Kishikawa; Yoshitaka Nishihara; Masayuki Okudaira, all of Tokyo, Japan

[73] Assignee: Toppan Printing Co., Ltd., Tokyo, Japan

[21] Appl. No.: 347,962

[22] PCT Filed: Jun. 30, 1988

[86] PCT No.: PCT/JP88/00659

§ 371 Date: Feb. 27, 1989

§ 102(e) Date: Feb. 27, 1989

[87] PCT Pub. No.: WO89/00136

PCT Pub. Date: Jan. 12, 1989

[30] Foreign Application Priority Data

| | | | |
|---|---|---|---|
| Jun. 30, 1987 | [JP] | Japan | 62-100844[U] |
| Aug. 25, 1987 | [JP] | Japan | 62-129044[U] |
| Aug. 25, 1987 | [JP] | Japan | 62-129045[U] |
| Aug. 25, 1987 | [JP] | Japan | 62-129046[U] |
| Feb. 5, 1988 | [JP] | Japan | 63-14408[U] |
| Feb. 15, 1988 | [JP] | Japan | 63-18449[U] |
| Jun. 14, 1988 | [JP] | Japan | 63-78454[U] |

[51] Int. Cl.[5] ..... B67D 5/06

[52] U.S. Cl. ..... 222/83; 222/81; 222/541

[58] Field of Search ..... 222/81–83.5, 222/91, 541; 220/265, 267, 277, 278

[56] References Cited

U.S. PATENT DOCUMENTS

| | | | |
|---|---|---|---|
| 3,369,707 | 2/1968 | Porter et al. | 222/83 |
| 4,475,670 | 10/1984 | Rutter | 222/83 |
| 4,483,464 | 11/1984 | Nomura | 222/83 |
| 4,493,438 | 1/1985 | Rutter | 222/83 |
| 4,602,725 | 7/1986 | Malpas et al. | 222/83.5 |
| 4,624,392 | 11/1986 | Malpas et al. | 222/83 |
| 4,798,605 | 1/1989 | Steiner et al. | 222/83 |

FOREIGN PATENT DOCUMENTS

| | | | |
|---|---|---|---|
| 304972 | 3/1989 | European Pat. Off. | 222/83 |
| 6062027 | 4/1985 | Japan | 222/83 |

*Primary Examiner*—Robert P. Olszewski
*Assistant Examiner*—Steven M. Reiss
*Attorney, Agent, or Firm*—Armstrong, Nikaido, Marmelstein, Kubovcik & Murray

[57] ABSTRACT

A pouring plug adapted to be attached to a container which comprises a pourer (2) attached to a pouring port of the container, a breading blade (4) inserted in the cylindrical section of said pourer (2) and provided with a blade section confronting a film at the lower edge thereof, and a cap, (3) attached rotatably covering said cylindrical section, provided with a pipe member which is inserted in the breaking blade (3), to define opposing surfaces between the pipe member and the breaking blade, (4) one of which is equipped with a guiding section which inclines with a rising gradient in the opening rotational direction ofthe cap (3) and extends from the upper edge side to the lower edge side of the pipe member, and the other of said opposing surfaces being provided with members which are slidably in contact with said guiding inclined section, whereby the breaking blade (4) is adapted to descend upon opening rotation of the cap (3) and wherein each of said guiding inclined sections comprises up to a semicircle of said opposing surfaces, and each of the slidably contacting members is either a projection or an inclined surface. Furthermore, either the guiding inclined section or the slidably contacting members are formed by notching the upper circumference of said breaking blade, (4), or the inner circumference of the breaking blade (4) has slidably contacting members formed from a pair of inclined surfaces along said inner circumferences.

6 Claims, 5 Drawing Sheets

FIG.1
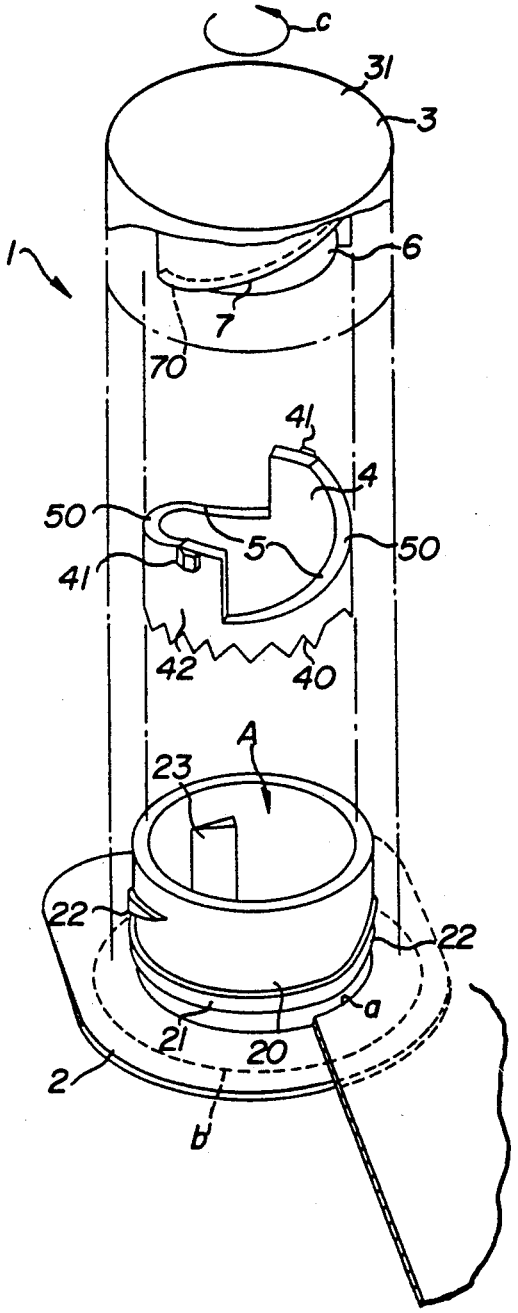
FIG.2
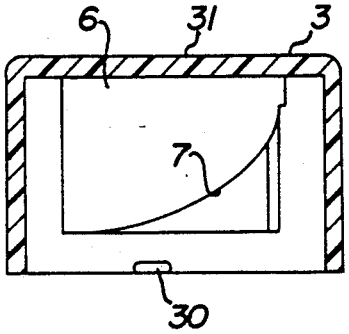
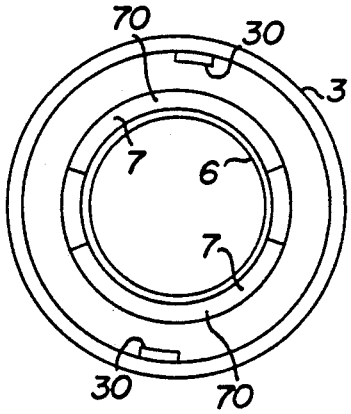
FIG. 3

FIG. 4
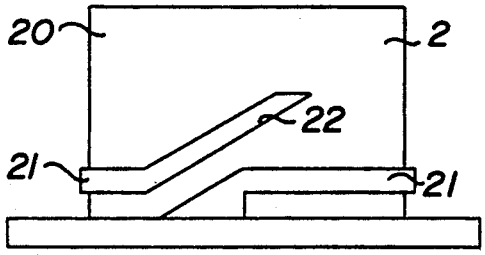
FIG. 5
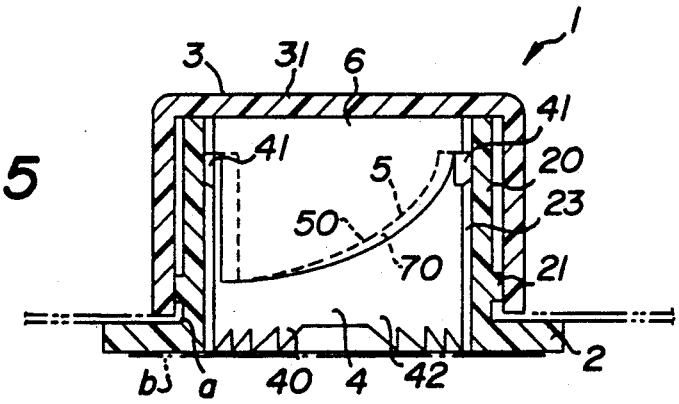
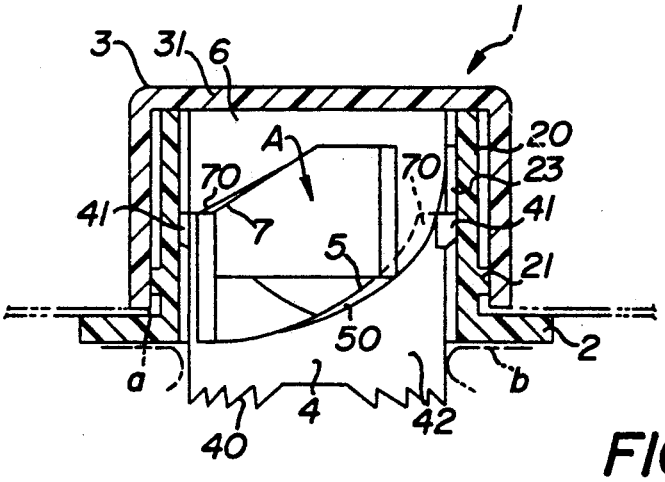
FIG. 6

FIG.7
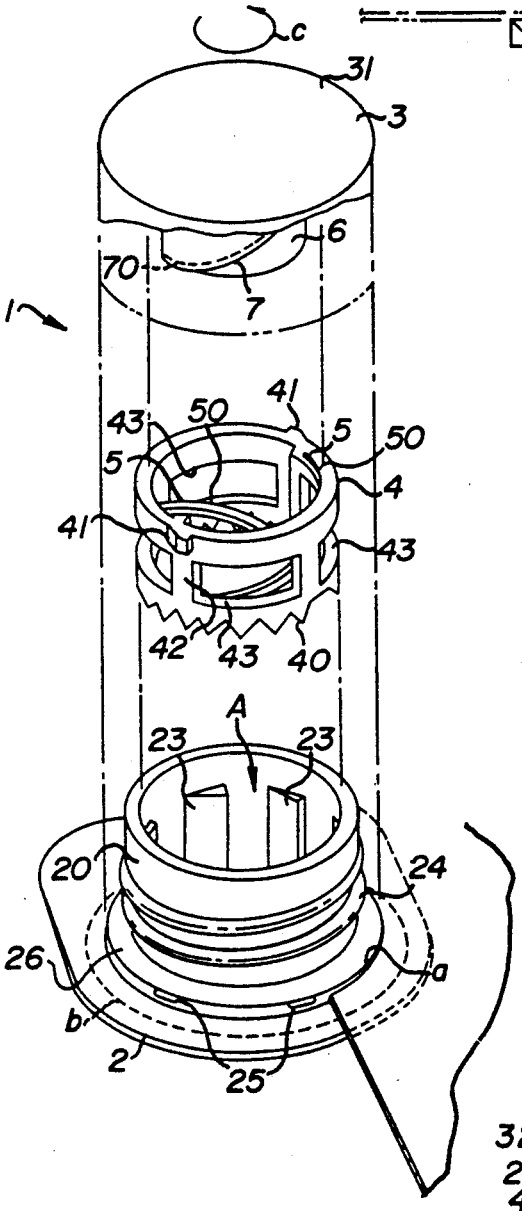
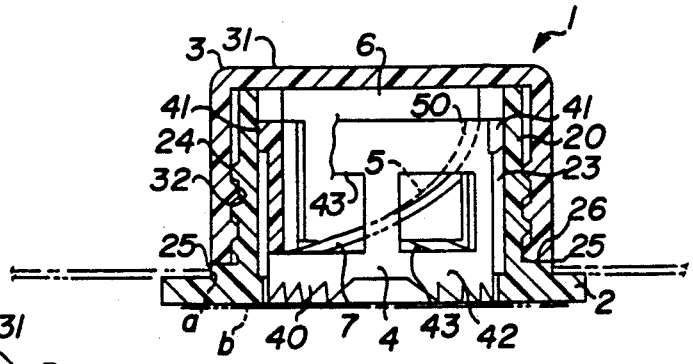
FIG.8
FIG.9
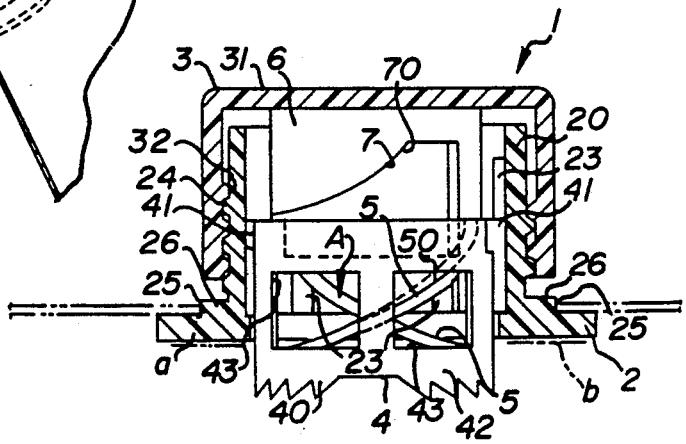

FIG. 10
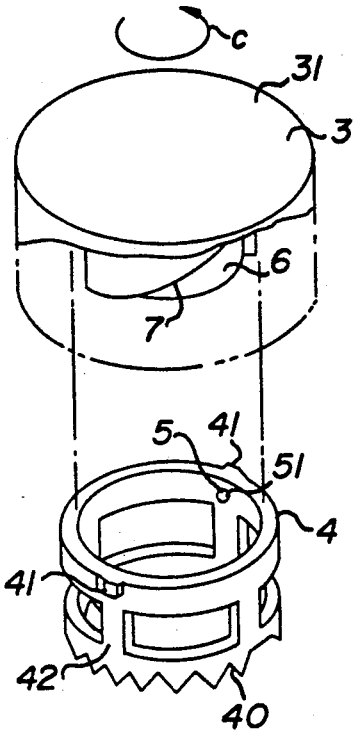
FIG. 12
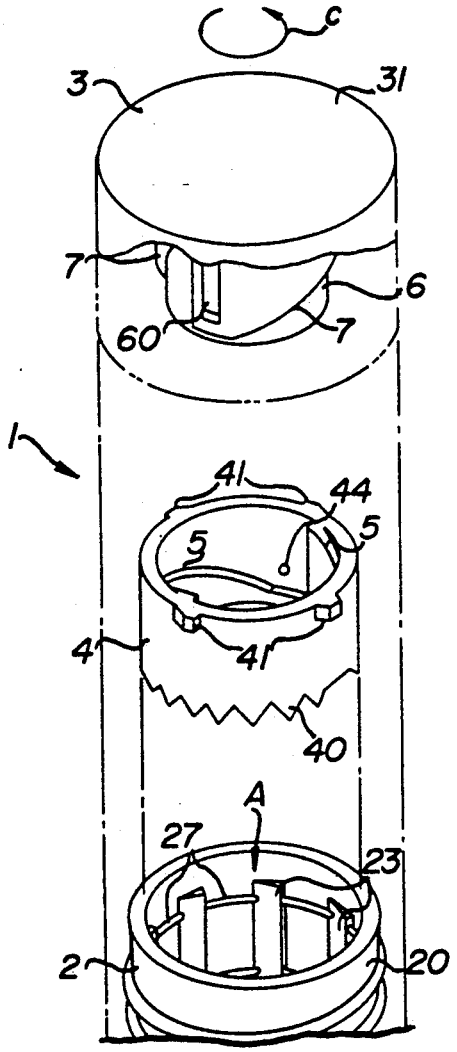
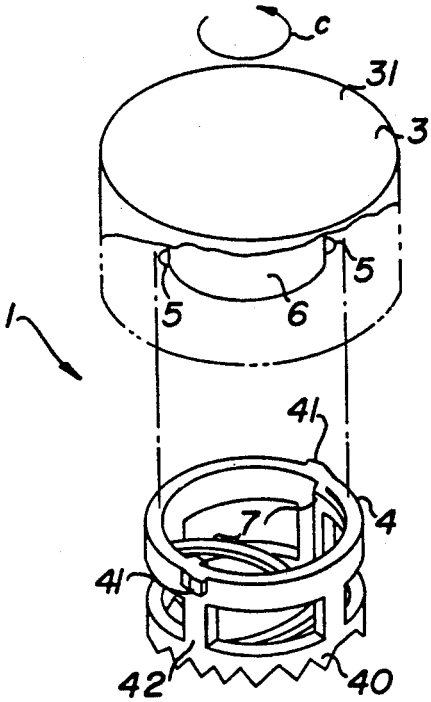
FIG. 11

POURING PLUG FOR LIQUID CONTAINER

TECHNICAL FIELD

This invention relates to a pouring plug for attachment to to a container containing liquid.

BACKGROUND ART

For the purpose of reducing manufacturing cost or weight of liquid containers, paper containers, such as a gable top type paper container and the like, have been conventionally used. In this connection, there has been proposed such a paper container equipped with a pouring plug made of a synthetic resin by which liquid is easily poured from the paper container and which comprises a pourer involving outer screws attached to the pouring port of a liquid container (paper container), an inner plug arranged inside said pourer in an up and down transferable manner, and a cap attached threadedly to said pourer. Said pouring plug has such a construction that said inner plug is forced to break down the film covering the pouring port in case of open the same thereby to opening the plug. Whilst, in case of storing the paper container, said cap has been arranged such that it is fitted into the pourer (see, for example, Japanese Utility Publication No. 37828/1988 official gazette). However, in such type of the pouring plug as described above, it is required to intensely force the inner plug into the plug assembly, by means of fingers, to break down the film as mentioned above, so that there were such problems that the pouring port was difficult to be broken down and that it was not hygienic because the fingers touch the pourer at the time of opening the pouring port.

Furthermore, Japanese Utility Model Publication No. 4558/1987 discloses such construction of a pouring plug that an inner plug which is higher than the pourer is placed inside said pourer, a cap is threadedly attached so as to cover the inner plug projecting from said pourer, and in case of opening a pouring port, said inner plug is depressed while allowing the cap to rotatively lower, thereby breaking down the film. In this pouring plug, however, the cap is located at a high position, a projecting dimension of the whole pouring plug from the liquid container is remarkable, so that the pouring plug itself or a site for attaching the pouring plug in the liquid container is easily damaged because of contact of the pouring plug with something in case of handling such as a conveyance for the liquid container. Moreover, it is required to once rotatively lower the cap in case of breaking down the film, so that opening operation for the pouring port has been troublesome.

On one hand, as described in Japanese Utility Model Publication No. 12335/1986 and Utility Model Laid-open No. 62027/1985, there have been proposed a pouring plug having such construction that an inner plug is screwed with its pourer, and when the cap is rotated, said inner plug descends rotatively to break down a film; and another pouring plug having such construction that a screw rod member threadedly engaged with its inner plug is disposed to a cap, and in case of rotative elevation of the cap, the inner plug is lowered by means of the rotation of said screw rod member thereby breaking down the film. In the construction of the pouring plug disclosed in Utility Model No. 12335/1986, however, it is required that the cap is allowed to rotate in a certain direction in case of opening its pouring port thereby to break down a film, and thereafter said cap is rotated in the reverse direction. In addition, the inner plug must be removed from the pourer so as to be capable of pouring out the contents from the liquid container so that operations for opening the pouring port and pouring out the contents become troublesome. Besides, it was necessary for such complicated operation, that the inner plug was attached to the pourer while rotating said inner plug in case of mounting the pouring plug. On the other hand, the construction of the pouring plug described in Utility Model Laid-open No. 62027/1985 has involved also such disadvantage that an inner plug must have been previously engaged threadedly with a screw rod member disposed on the cap so that operation for attaching the pouring plug becomes complicated. Besides, since a screw portion for engaging threadedly with said screw rod member has been provided at the central portion of the inner plug, a large flowing section cannot be constructed at the central portion of the inner plug, and as a result there was an obstacle to pouring out the contents from the liquid container.

Accordingly, the present invention has been made for the purpose of solving the conventional disadvantages as described above, and an object of which is to provide a pouring plug which can break down a film by means of an easy operation. In addition, it is another object of the present invention to provide a pouring plug having a simple construction and the attachment thereof can easily be effected with respect to a liquid container.

DISCLOSURE OF THE INVENTION

More specifically, the present invention relates to a pouring plug comprising a pourer which is attached to the pouring port of a liquid container and the lower edge opening of which corresponds to a film which is easily breakable and is utilized for sealing said pouring port or the lower edge opening thereof, a substantially cylindrical breaking blade which is inserted in the cylindrical section of said pourer in an up and down transferable manner and provided with a blade section confronting said film at the lower edge thereof, and a cap attached rotatably so as to cover said cylindrical section, said cap being provided with a pipe member which is inserted in the breaking blade, one of the opposing surfaces defined between the pipe member and the breaking blade being equipped with a guiding inclined section which inclines with a rising gradient in the opening rotational direction of the cap extending from the upper edge side to the lower edge side of the pipe member, and the other of said opposing surfaces being provided with slidably contacting members which are slidably in contact with said guiding inclined section, whereby the breaking blade is arranged in a descendable manner at the time of opening rotation for the cap. Thus, when the cap is rotated in the opening direction (is rotationally elevated), the breaking blade is forced downwards to be lowered by rotation of the pipe member, and then the breaking blade breaks down the film to open the pouring opening, whereby the liquid in the container can be poured out by means of removing the cap.

Furthermore, in the present invention, each of said guiding inclined sections is disposed within the range of a semicircle or a narrower range of said opposing surfaces. Because of this arrangement, the breaking blade can be mounted on the pipe member of said cap without rotating the same in case of such attachment of the breaking blade.

Moreover, according to the present invention, the pouring plug is provided with a locking means temporarily fixing the breaking blade to the cap, and in the pouring plug, the breaking blade is locked, with respect to the inner circumference of the pourer, in a locatable manner. Hence, said breaking blade cannot become disengaged from the pipe member upon attaching the cap to the pourer, so that unnecessary transfer, backlash and the like of the breaking blade after the attachment thereof are suppressed.

BRIEF DESCRIPTION OF THE DRAWINGS

FIG. 1 is an exploded perspective view showing a first example of a pouring plug for a liquid container according to the present invention;

FIG. 2 is a second elevation view showing the cap, with portions broken away, according to the first example;

FIG. 3 is a plan view viewed from the back of the cap according to the first example;

FIG. 4 is an elevation view showing the pourer according to the first example;

FIG. 5 is a sectional elevation view showing the pouring plug according to the first example in a state before the pouring plug is opened;

FIG. 6 is a sectional elevation view showing the pouring plug according to the first example in a state after the pouring plug is opened;

FIG. 7 is an exploded perspective view showing a second example according to the present invention;

FIG. 8 is a sectional elevation view illustrating the second example in a state before the pouring plug is opened;

FIG. 9 is a sectional elevation view illustrating the second example in a state after the pouring plug is opened;

FIG. 10 is an exploded perspective view illustrating a third example according to the present invention;

FIG. 11 is an exploded perspective view illustrating a fourth example according to the present invention;

FIG. 12 is an exploded perspective view illustrating a fifth example according to the present invention;

BEST MODE FOR EMBODYING THE INVENTION

Figure 13:
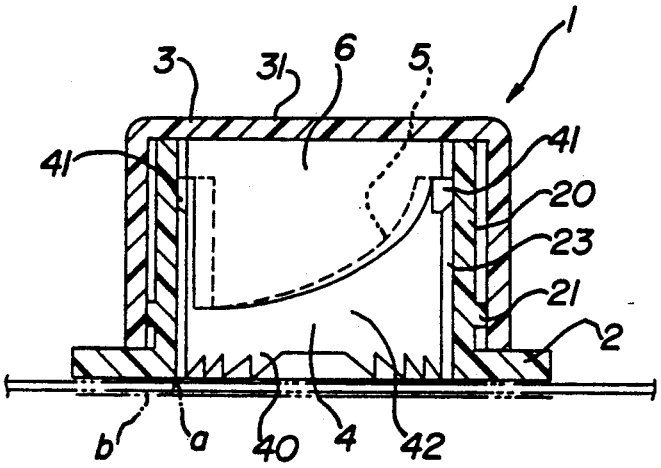
FIG. 13 is a sectional elevation view illustrating the fifth example, in a state before the pouring plug is opened.
Figure 14:
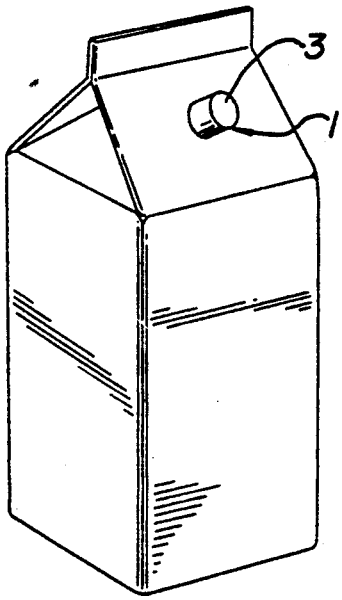
FIG. 14 is a perspective view showing a liquid container, having a pouring plug according to this invention.

Next, the present invention will be described in detail on the basis of the examples shown in FIGS. 1 through 14, respectively, wherein reference numeral 1 designates a pouring plug, made of a synthetic resin, which is attached to a pouring port which is preferably installed on an inclined surface in the upper portion of a container, for example, a gable top type container. A pourer 2 of said pouring plug 1 is fastened to the pouring port, (by means of ultrasonic welding or the like, from the reverse side of the inclined surface in the upper part of the container (the inside of the container) as shown in FIG. 14. More specifically, the pouring plug is formed such that a pouring opening A, which will be communicated with the inside of the container, is surrounded by a cylindrical portion 20 protruding from said inclined surface in the upper portion of the container (the pouring opening A has been previously sealed with the undermentioned film).

Said cylindrical portion 20 is fitted with a cap 3 so as to cover the same. Projections 30, which extend from the lower edge sides on the inner surface of said cap 3 in an opposed state, can be locked with respect to a jetty 21 positioned around the base of the cylindrical portion 20 as well as jetties 22 each of which continues from one end of the jetty 21 and inclines upwards so as to be capable of upwardly transferring the cap 3. The cap 3 is arranged such that it can be rotated by utilizing said jetties 21 and 22 as guides. Each of said projections 30, as well as inclined jetties 22, are positioned at opposed positions and they form a pair of components, respectively.

An easily breakable film b is provided on a lower edge opening of the pourer 2 positioned so as to front on the inside of the container, and the pouring opening A is sealed with said film b. Into the pouring opening A, a substantially cylindrical breaking blade 4, the lower edge of which is formed into a blade section 40, is inserted in a confronting state upon said film b. Projections 41 extend sidewards from the breaking blade 4 at opposite positions on the upper edge section of said breaking blade 4 along diametrical opposed directions thereof, respectively. The respective projections 41 are engaged with a longitudinal protuberance 23 placed inside the cylindrical portion 20 in an up and down movable manner, whereby they are arranged such that the breaking blade 4 can descend towards the film b without rotating the blade itself. It is intended to prevent complete dropping of the film which had been cut, because of construction of the breaking blade such that a the length of the blade section is not constant, but shorter lengths may be set at certain portion thereof, where there is no blade. Furthermore, in the breaking blade 4, slidably contacting members 5 are provided at positions opposite to each other in the diametrical direction thereof as shown in FIG. 1, and these slidably contacting members 5 are inclined surfaces 50 each of which is formed by cutting off a cylindrical wall section 42 which extends from the upper end to the side of the blade section 40 in the same direction with that of the jetty 21 of the cylindrical portion 20. The inclination of the surface 50 is sharp, so that these inclined surfaces are within the respective semicircles of the cylindrical portion or narrower ranges.

A pipe member 6 is inserted in said breaking blade suspended from the back of the top section 31 of said cap 3. As shown in FIG. 3, guiding inclined sections 7, each of which having a bottom 70 which is inclined from the side of the top section 31 to the lower edge along the outer surface of the pipe member 6, are disposed at the position opposed to the diametrical direction of the pipe member 6. Each of the guiding inclined sections 7 extends in the same direction as that of the jetty 21 and the inclination of the guiding inclined section 7 is sharply slanted, such that these guiding inclined sections are contained in the semicircles of the pipe member 6, respectively. These guiding inclined sections 7 correspond to the slidably contacting members 5 in the breaking blade 4, so that they are arranged such that the corresponding surfaces of the guiding inclined sections 7 and the slidably contacting members 5 (the bottoms 70 and the inclined surfaces 50) can be in slidable contact with each other. Since each of the guiding inclined sections 7 and each of the slidably contacting members 5, which are inclined in the same direction with respect to each other, are disposed in a slidably contacting state between the opposite surfaces of the breaking blade and the pipe member as described above. When the cap 3 is rotated in the opening direction, the pipe member 6 is rotated and the projections 41 are engaged with the protuberance 23. As a result, the breaking blade 4 is urged downwards, i.e. the blade is pushed down towards the film b.

In order to open the lower edge opening of the pouring opening in the pouring plug 1 having the construction described above, it is sufficient to rotate the cap 3 in the direction for opening the pouring plug (the direction is indicated by arrow c). More specifically, the pouring opening A can be opened by such a very easy operation of rotating the cap 3 which brings about rotation of the pipe member 6 to allow the breaking blade 4 to descend, and the film b is broken by the descending breaking blade 4. Thereafter, the cap 3 is rotated to remove the same from the pourer 2 while transferring projections 30 along the inclined jetties 22, so that the contents in the container can be poured out through the pouring opening A communicating with the inside of the container. On the other hand, the breaking blade 4 which has broken down the film b due to its descent is never raised by this cap 3, even if the cap 3 is reversely rotated (In other words, since the guiding inclined sections are not in an engaged relationship with the slidably contacting members, said slidably contacting members are never raised along the guiding inclined sections). Accordingly, since the breaking blade is positioned at the lower edge opening which does not move up and down, the pouring opening can easily be sealed again by means of the cap. In addition, broken pieces of the film are not caught by the gap defined between the breaking blade and the pourer, and at the same time dropping of the broken film pieces into the container due to complete cutting thereof is prevented.

Furthermore, since both the guiding inclined sections and the slidably contacting members, which form a pair of such members opposite to each other along the diametrical direction thereof, are within the semicircular planes, respectively, the breaking blade can easily be mounted on the pipe member without requiring rotation of said breaking blade.

FIGS. 7 to 9 illustrates another example in which a cylindrical wall section 42 is not notched in a saw-toothed condition in a breaking blade 4 according to the present example, but spiral slidably contacting members 5, corresponding to guiding inclined sections 7 in the pipe member 6, are provided in a direction extending from the upper end of the cylindrical wall section 42 to the side of the blade section 40 along the inner surface of the cylindrical wall section 42. Moreover, throughholes 43 are defined on the cylindrical wall section 42 for making the circulation of contents favorable.

Unlike the above-mentioned example, the pourer 2 and the cap 3 of the present example are arranged such that the cap 3, involving an inside screw 32 thereon, is threadedly attached to an outside screw 24 which is threaded around the outer circumference of a cylindrical section 20. In this construction, when the cap 3 is rotated (subjected to the opening rotation) so as to raise the same, the cap is removed from the pourer 2 to open a pouring opening A. As in the above described example, the pipe member 6 is rotated and projections 41 are engaged with protuberances 23 at the time of the opening rotation for said cap 3, respectively, so that a breaking blade 4 descends to break down a film b thereby opening the pouring opening A. While a pair of protuberances 23 are opposed to each other in the diametrical direction of the cylindrical section 20 in the above example, it is not limited thereto, but many protuberances may be disposed inside the cylindrical section 20 as shown in FIG. 7.

Moreover, the pouring plug may be arranged such that a stepped section 26 equipped with pawls 25 around the base of the cylindrical section 20 is provided, and the stepped section 26 is then fitted in a pouring port a to engage said pawls 25 with the circumference of the pouring port a, whereby said pouring plug 1 is fixed firmly to the container main body.

In the examples shown in FIGS. 1 to 9, although the slidably contacting members, each of which is slidably in contact with the guiding inclined section of a pipe member, are formed by notching the cylindrical wall portion of a breaking blade, or from a spiral member along the inside of the cylindrical wall portion, such slidably contacting members are not limited thereto. More specifically, slidably contacting members 5 may be projections 51 extending from the positions opposed to each other along the diametrical direction thereof on the inner surface of the upper edge of the breaking blade 4 as shown in FIG. 10, and the slidably contacting members 5, being the projections 51, may have such construction that they are slidably in contact with the bottoms of the guiding inclined sections 7.

Furthermore, as a reverse construction of the slidably contacting member described above, it may be arranged such that said guiding inclined sections 7 are placed on the inner surface of the breaking blade 4 as shown in FIG. 1, besides the slidably contacting members 5 which extend from positions opposed to each other in the diametrical direction thereof on the lower edge of the pipe member, and the slidably contacting members 5, being the projections 52, are allowed to be slidably in contact with said guiding inclined sections 7, respectively.

In order to assure the attachment of the breaking blade 4 to the pipe member 6, in case of mounting the cap 3 on the pourer 2, a locking means for temporary fixation can be constructed. In this connection, a longitudinal groove 60 is defined on the outermost side of a pipe member 6, and at the same time a projection 44, which corresponds to the longitudinal groove 60 and is unlockable with respect thereto, may be extended from the inner surface of a cylindrical section 20 as shown in FIG. 12. Thus, the projection 44 is locked in the longitudinal groove 60 so that the breaking blade 4 has been previously fixed temporarily to the pipe member 6, whereby the cap 3 can be easily mounted to the pourer 2 without slipping off the breaking blade 4. The projection 33 is, of course, detached easily from the longitudinal groove 60 in case of opening rotation for the cap 3 after mounting the same. In this case, the positional relationship between the longitudinal groove and the projection may be reversed.

Moreover, as shown in FIG. 12, when protuberances 27, with respect to which projections 41 provided on the upper edge on the outside of the breaking blade 4 (four projections are disposed at the four corners of the breaking blade in FIG. 12) are locked and which can be easily climbed over by said projections, are disposed circumferentially on the inner side at the upper edge of the cylindrical section 20, the breaking blade is located temporarily at the upper portion before breaking the film, whereby an unguarded up and down movement of the breaking blade 4 can be suppressed. In this case, it is not necessary that such protuberances are continuous in the circumferential direction thereof, but may be discontinuous so far as said projections 41 can be locked thereby.

While the film is attached so as to seal the lower edge opening of the pourer in the above-mentioned examples, the pourer 2, and in its turn the pouring plug, may be attached in such a manner that the pouring port a of the liquid container is sealed with a film b, and its lower edge opening is allowed to correspond to the thus sealed pouring port a.

INDUSTRIAL APPLICABILITY

As described above, according to the present invention, the pouring plug comprises a pourer which is attached to the pouring port of a liquid container and the lower edge opening of which corresponds to an easily breakable film and utilizes for sealing said pouring port or the lower edge opening thereof; a substantially cylindrical breaking blade which is inserted in the cylindrical section of said pourer in an up and down transferable manner and provided with a blade section confronting said film at the lower edge thereof; and a cap attached rotatably so as to cover said cylindrical section; said cap being provided with a pipe member which is inserted in the breaking blade; one of the opposing surfaces defined between the pipe member and the breaking blade being equipped with a guiding inclined section which inclines with a rising gradient in the opening rotational direction of the cap extending from the upper edge side to the lower edge side of the pipe member; and the other of said opposing surfaces being provided with slidably contacting members which are slidably in contact with said guiding inclined section, whereby the breaking blade is arranged in a descendable manner at the time of opening rotation for the cap. Thus, the breaking blade descends by such a simple operation of rotating the cap to break down the film to open the pouring opening, and as a result such breaking or opening operation becomes easy, besides since a user never touches the pourer, the breaking blade, the film and the like, in case of breaking down the sealing in a container, such container is hygienic. Furthermore, if the film has been previously attached to the pourer, such pourer can be attached from the inside of the container, so that the appearance of the container is never damaged around the pourer, and in addition the present invention provides the other practically excellent advantages.

We claim:

1. A pouring plug for a liquid container, comprising a pourer which is attached to a pouring port of the liquid container and the lower edge opening of which corresponds to an easily breakable film which seals said pouring port or the lower edge opening thereof; a substantially cylindrical breaking blade inserted in the cylindrical section of said pourer in an up and down transferable manner and provided with blade section confronting said film at the lower edge thereof; and a cap attached rotatably so as to cover said cylindrical section; said cap being provided with a pipe member which is inserted in the breaking blade; one of the opposing surfaces defined between the pipe member and the breaking blade being equipped with a guiding inclined section which inclines with a rising gradient in the opening rotational direction of the cap extending from the upper edge side to the lower edge side of the pipe member; and the other of said opposing surfaces being provided with slidably contacting members which are slidably in contact with said guiding inclined section, whereby the breaking blade is arranged to descend at the time of applying an opening rotation to the cap.

2. A pouring plug for a liquid container as claimed in claim 1 wherein each of said guiding inclined sections is disposed within a range of a semicircle or a narrower range of said opposing surfaces.

3. A pouring plug for a liquid container as claimed in any one of claims 1 or 2 wherein each of the slidably contacting members which are slidably in contact with said guiding inclined section is either a projection or an inclined surface.

4. A pouring plug for a liquid container as claimed in any one of claims 1 or 2 wherein either of the guiding inclined section or the slidably contacting members are formed by cutting off the upper circumference of said breaking blade.

5. A pouring plug for a liquid container as claimed in claim 1 including a locking means for temporarily fixing said breaking blade to said cap.

6. A pouring plug for a liquid container as claimed in claim 1 wherein said breaking blade is locked onto the inner circumference of aid pourer in a predetermined position.

* * * * *